US009051149B2

(12) United States Patent
Matsumine

(10) Patent No.: US 9,051,149 B2
(45) Date of Patent: Jun. 9, 2015

(54) SHEET EJECTION DEVICE

(71) Applicant: RISO KAGAKU CORPORATION, Tokyo (JP)

(72) Inventor: Yukimori Matsumine, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/133,202

(22) Filed: Dec. 18, 2013

(65) Prior Publication Data

US 2014/0183814 A1 Jul. 3, 2014

(30) Foreign Application Priority Data

Dec. 27, 2012 (JP) ..... 2012-284852

(51) Int. Cl.

| | |
|---|---|
| ***B65H 31/10*** | (2006.01) |
| ***B65H 31/20*** | (2006.01) |
| ***B65H 43/02*** | (2006.01) |
| ***B65H 43/08*** | (2006.01) |
| ***G03G 15/00*** | (2006.01) |

(52) U.S. Cl.

CPC ..... *B65H 31/10* (2013.01); *B65H 31/20* (2013.01); *B65H 43/02* (2013.01); *B65H 43/08* (2013.01); *B65H 2405/1111* (2013.01); *B65H 2405/1115* (2013.01); *B65H 2511/222* (2013.01); *B65H 2511/30* (2013.01); *B65H 2511/51* (2013.01); *B65H 2511/515* (2013.01); *B65H 2513/512* (2013.01); *B65H 2553/412* (2013.01); *B65H 2801/06* (2013.01); *G03G 15/6552* (2013.01)

(58) Field of Classification Search

CPC ..... B65H 31/10; B65H 31/04; B65H 31/18; B65H 43/08

USPC ..... 271/214, 217, 215, 213, 207

See application file for complete search history.

(56) References Cited

U.S. PATENT DOCUMENTS 8,708,336 B2 * 4/2014 Taguchi ..... 271/214

FOREIGN PATENT DOCUMENTS

| | | | |
|---|---|---|---|
| JP | 11-071053 | | 3/1999 |
| JP | 11130321 | A * | 5/1999 |
| JP | 2005187130 | A * | 7/2005 |
| JP | 2010189182 | A * | 9/2010 |

* cited by examiner

*Primary Examiner* — Luis A Gonzalez

(74) *Attorney, Agent, or Firm* — Greenblum & Bernstein, P.L.C.

(57) ABSTRACT

A sheet ejection device includes a sheet receiving tray provided with a sheet stack plane, a detector for detecting ejected sheets at a reference position, and a controller. Both side end of the sheet stack plane is made higher than a center thereof when viewed along a sheet ejection direction. The reference position functions as a reference for a height level of a center of an uppermost surface of stacked sheets on the sheet stack plane. During a sheet ejection operation, the controller moves the tray downward by a preset height level every ejection of a preset number of sheets until the detector detects sheets, and then newly starts to move the tray downward by the preset height level every ejection of the preset number of sheets from a time when the detector detects sheets. According to the device, sheets can be prevented from being stacked on the tray erroneously.

2 Claims, 6 Drawing Sheets

SHEET EJECTION DEVICE

BACKGROUND OF THE INVENTION

1. Technical Field

The present invention relates to a sheet ejection device for ejecting printed sheets.

2. Background Arts

A Patent Document 1 (Japanese Unexamined Patent Application Publication No. H11-71053) discloses a sheet ejection device that includes a vertically movable sheet receiving tray. In the sheet ejection device, the sheet receiving tray is moved downward along with increase of stacked sheets that are sequentially ejected onto the sheet receiving tray.

Also known is a sheet ejection devise in which both side of its vertically movable sheet receiving tray are made higher than a center of the sheet receiving tray when viewed along a sheet ejection direction. Namely, a sheet stack plane of the sheet receiving tray is wide-opened V-shaped when viewed along the sheet ejection direction. Here, the sheet receiving tray is moved downward based on detection results of a sensor that detects, at a bottom of the V-shape, sheets stacked on the sheet receiving tray.

SUMMARY OF THE INVENTION

In the sheet ejection device including the sheet receiving tray whose sheet stack plane is V-shaped as mentioned above, a gap may be formed between sheets stacked on the sheet receiving tray and the bottom of the V-shaped sheet stack plane of the sheet receiving tray. For example, when small-sized and thick sheets are stacked on the sheet receiving tray, the sheets may not follow the V-shape of the sheet receiving tray and thereby a gap is formed.

If such a gap is formed, the sensor may not be able to detect, at the bottom of the V-shape, the sheets correctly. In this case, the sheet receiving tray cannot be moved downward adequately, so that the sheets may be stacked erroneously. For example, if the sensor can't detect sheets due to the gap, the ejection sheet tray is not moved downward but sheets are continuously stacked thereon. When the stacked sheets reach a sheet ejection port, sheet jams may occur.

An object of the present invention is to provide a sheet ejection device that can prevent erroneous sheet stacking.

An aspect of the present invention provides a sheet ejection device comprising: a vertically movable sheet receiving tray that is provided with a sheet stack plane, both side end of the sheet stack plane being made higher than a center of the sheet stack plane when viewed along a sheet ejection direction; a sheet ejection unit that sequentially ejects sheets onto the sheet receiving tray; a detector that detects sheets ejected by the sheet ejection unit at a reference position, the reference position being a position that functions as a reference for a height level of a center of an uppermost surface of stacked sheets on the sheet stack plane; and a controller, during a sheet ejection operation, moves the sheet receiving tray downward by a preset height level every ejection of a preset number of sheets until the detector detects sheets at the reference position, and then newly starts to moves the sheet receiving tray downward by the preset height level every ejection of the preset number of sheets from a time when the detector detects sheets at the reference position.

According to the above aspect, sheets are prevented from being stacked on the sheet receiving tray continuously when the ejection sheet tray can't be moved downward due to a gap formed between the sheet stack plane and sheets tacked on the sheet stack plane of the sheet receiving tray. Therefore, erroneous stacking of sheets can be prevented.

It is preferable that, when the controller moves the sheet receiving tray downward a preset times before the detector firstly detects sheets at the reference position, the controller stops the sheet ejection operation.

According to this configuration, ejected sheets can be prevented from being misaligned further.

DESCRIPTION OF THE EMBODIMENTS

Figure 1:
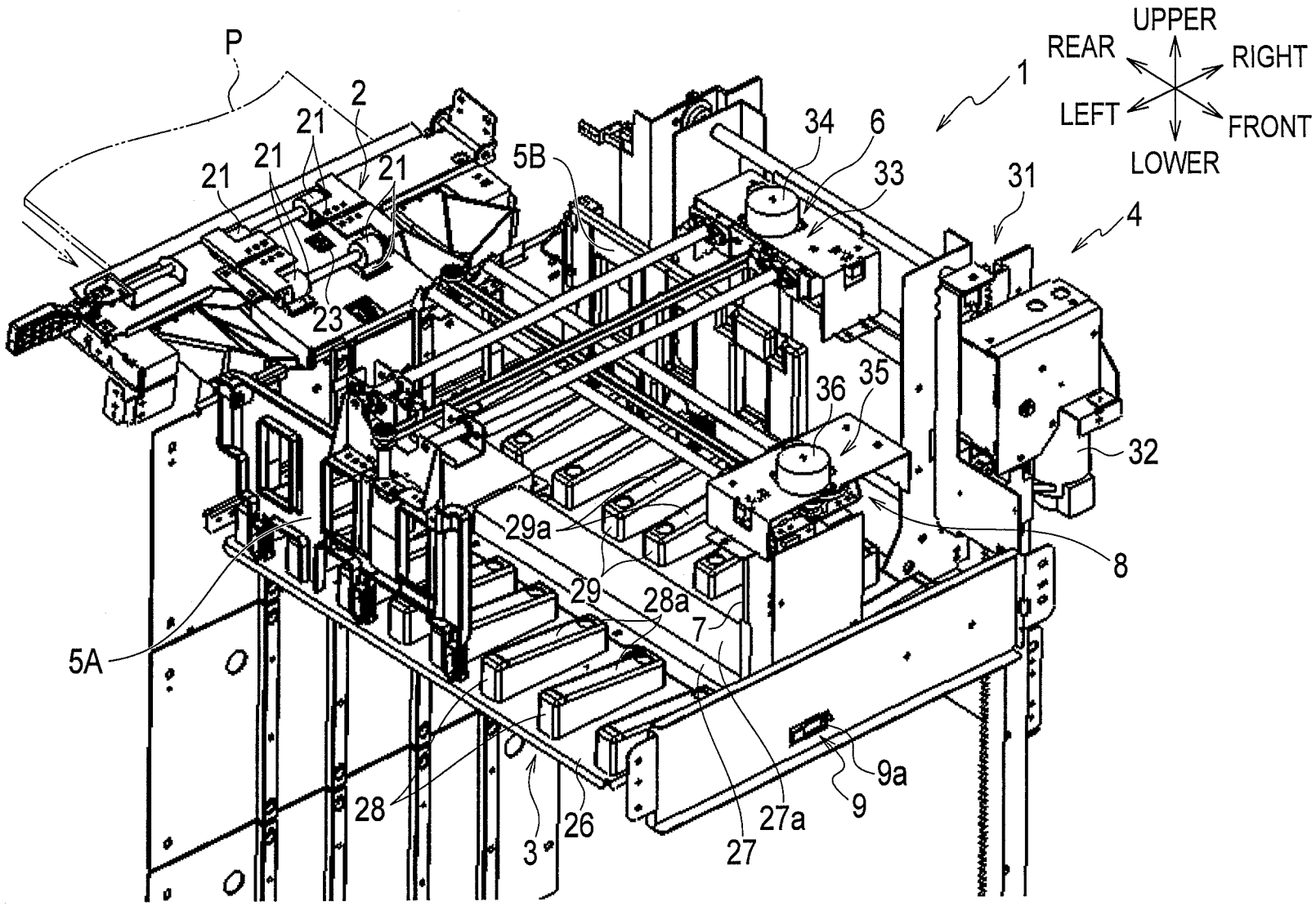
FIG. 1 is a perspective view of a sheet ejection device according to an embodiment.

Hereinafter, an embodiment will be explained with reference to the drawings. In the drawings, an identical or equivalent component is indicated by an identical reference number. Note that the drawings show components schematically, and it should be considered that the components in the drawings are not shown precisely as they are. In addition, actual dimensions of the components and actual dimensional proportions among the components may be shown differently in the drawings.

Further, the embodiment described below is explained as an example that specifically carries out the subject matter of the present invention. In addition, materials, shapes, structures, arrangements of the components are not limited to those in the embodiment. The embodiment may be modified within the scope of the claims (e.g. arrangement of the components may be changed from the embodiment).

In the following explanations, as shown in FIG. 1, a side of a leading edge of an ejected sheet (paper) P is denoted as front, and a side of a trailing edge thereof is denoted as rear. In addition, upper, lower, left and right are also denoted by viewing from front.

Figure 2:
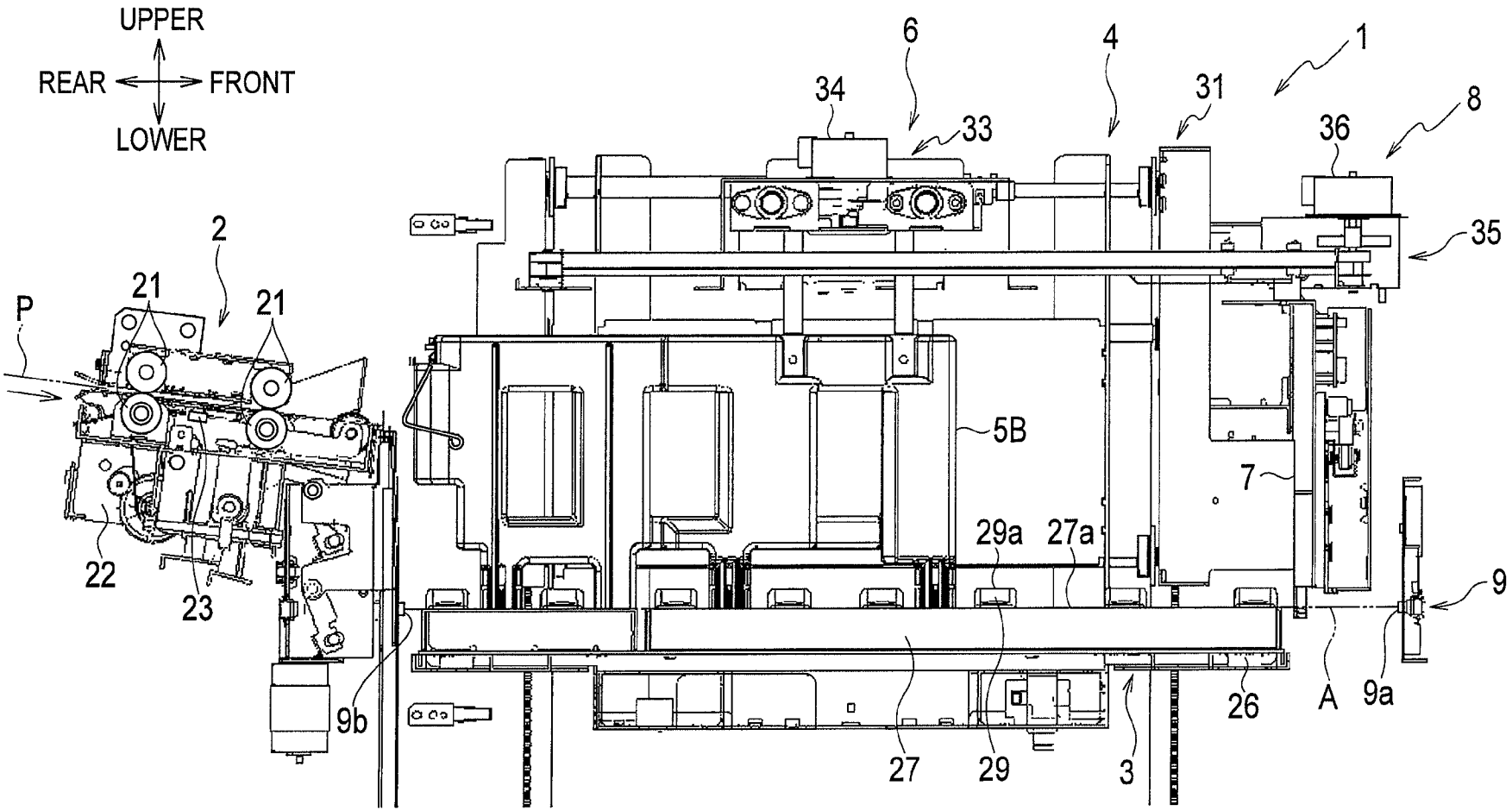
FIG. 2 is a cross-sectional side view of the sheet ejection device.
Figure 3:
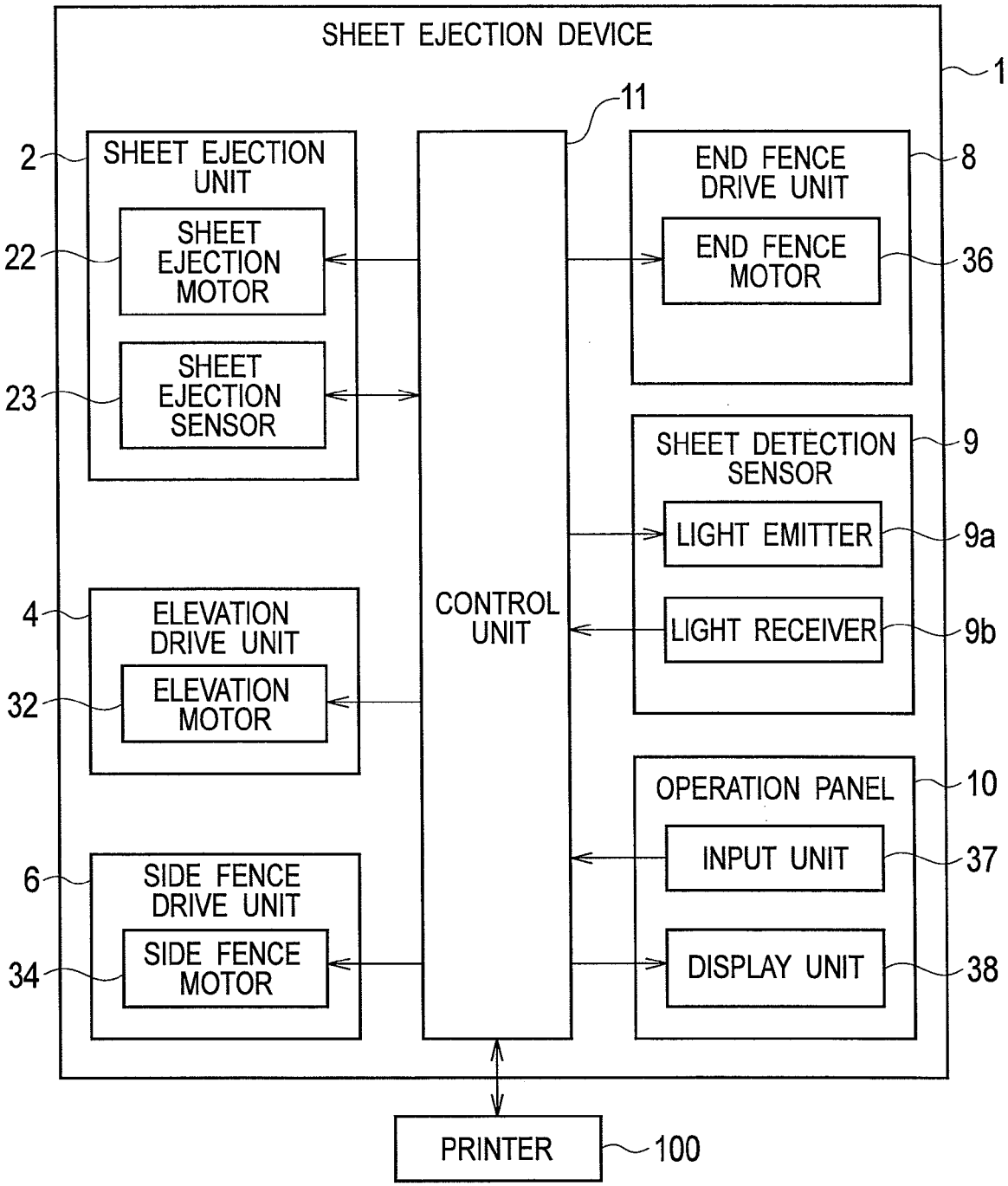
FIG. 3 is a block diagram of the sheet ejection device.

As shown in FIG. 1 to FIG. 3, a sheet ejection device 1 according to the present embodiment includes a sheet ejection unit 2, a vertically movable sheet receiving tray 3, an elevation drive unit 4, a pair of side fences 5A and 5B, a side fence drive unit 6, an end fence 7, an end fence drive unit 8, a sheet detection sensor (a detector) 9, an operation panel 10, and a controller 11. The sheet ejection device 1 is connected with a printer 100.

The sheet ejection unit 2 ejects sheets (papers) P printed by the printer 100 onto the sheet receiving tray 3. The sheet ejection unit 2 includes plural sheet ejection rollers 21, a sheet ejection motor 22 and a sheet ejection sensor 23. The sheet ejection rollers 21 feed sheets P sequentially, and eject them onto the sheet receiving tray 3. The sheet ejection motor 22 derives the sheet ejection rollers 21. The sheet ejection sensor 23 detects sheets P sequentially ejected onto the sheet receiving tray 3 by the sheet ejection rollers 21. The sheet ejection sensor 23 is disposed beneath a feed path of sheets P fed by the sheet ejection rollers 21. The sheet ejection sensor 23 is a reflective optical sensor.

The sheet receiving tray 3 receives sheets P sequentially ejected from the sheet ejection unit 2, and stacks them on itself. The sheet receiving tray 3 includes a bottom plate 26 having a rectangular outline when viewed from above, a center stem 27, and ribs 28 and 29. The center stem 27 is extended from rear to front on a center of the bottom plate 26. An upper surface 27*a* of the center stem 27 is an almost horizontal flat surface. The upper surface 27*a* configures part of a sheet stack plane of the sheet receiving tray 3.

The ribs 28 are aligned on a left side of the center stem 27, and each of them is extended from left toward the center stem 27. The ribs 29 are aligned on a right side of the center stem 27, and each of them is extended from right toward the center stem 27. Each of the ribs 28 has a sloped upper surface 28*a*. A right end of the sloped upper surface 28*a* has the same height as the height of the center stem 27, and a left end of the sloped upper surface 28*a* is made higher than the height of the right end. Symmetrically, each of the ribs 29 has a sloped upper surface 29*a*. A left end of the sloped upper surface 29*a* has the same height as the height of the center stem 27, and a right end of the sloped upper surface 28*a* is made higher than the height of the left end. The sloped upper surfaces 28*a* and 29*a* also configure part of the sheet stack plane of the sheet receiving tray 3. Therefore, the sheet stack plane is configured by the upper surface 27*a* and the sloped upper surfaces 28*a* and 29*a*, so that it is almost wide-opened V-shaped when viewed along a sheet ejection direction (viewed from front). Stacked sheets P follow the V-shape of the sheet stack plane and are slightly curved, so that alignment of the stacked sheets P can be improved.

The elevation drive unit 4 moves the sheet receiving tray 3 vertically. The elevation drive unit 4 includes an elevation mechanism 31, and an elevation motor 32. The elevation mechanism 31 includes a rack and pinion mechanism to elevate the sheet receiving tray 3 by using a drive force generated by the elevation motor 32. The elevation motor 32 generates the drive force for elevating the sheet receiving tray 3. The sheet receiving tray 3 is moved upward when the elevation motor 32 is driven in a normal rotational direction. On the other hand, the sheet receiving tray 3 is moved downward when the elevation motor 32 is driven in a reverse rotational direction.

The pair of side fences 5A and 5B restricts both side edges of stacked sheets P along a sheet width direction (left-to-right direction) to align the stacked sheets P laterally. The side fences 5A and 5B are hung down above the sheet receiving tray 3, and mechanistically independent from the sheet receiving tray 3. The side fences 5A and 5B are distanced away from each other along the left-to-right direction.

The side fence drive unit 6 slides the side fences 5A and 5B synchronously. The side fence drive unit 6 includes a side fence slide mechanism 33, and a side fence motor 34. The side fence slide mechanism 33 moves the side fences 5A and 5B laterally by using a drive force generated by the side fence motor 34. The side fence slide mechanism 33 is disposed above the pair of the side fences 5A and 5B. The side fence motor 34 generates the drive force for sliding the side fences 5A and 5B. The side fences 5A and 5B are made closer to each other when the side fence motor 34 is driven in a normal rotational direction. On the other hand, the side fences 5A and 5B are made distanced away from each other when the side fence motor 34 is driven in a reverse rotational direction.

The end fence 7 restricts leading edges stacked sheets P to align the stacked sheets P along a sheet ejection direction. The end fence 7 is hung down above the sheet receiving tray 3, and mechanistically independent from the sheet receiving tray 3.

The end fence drive unit 8 shifts the end fence 7. The end fence drive unit 8 includes an end fence shift mechanism 35, and an end fence motor 36. The end fence shift mechanism 35 shifts the side fences 5A and 5B along the sheet ejection direction by using a drive force generated by the end fence motor 36. The end fence shift mechanism 35 is disposed above the end fence 7. The end fence motor 36 generates the drive force for shifting the end fence 7. The end fence 7 is shifted forward when the end fence motor 36 is driven in a normal rotational direction. On the other hand, the end fence 7 is shifted rearward when the end fence motor 36 is driven in a reverse rotational direction.

The sheet detection sensor 9 detects existence of sheets P at a reference position. The reference position is a position functioning as a reference for a height level (an upper surface position) of a center of an uppermost surface of stacked sheets P on the sheet stack plane of the sheet receiving tray 3. The reference position is disposed at a lower level than the sheet ejection rollers 21. The sheet detection sensor 9 is a transmissive optical sensor, and includes a light emitter 9*a* and a light receiver 9*b*. The light emitter 9*a* and the light receiver 9*b* are oppositely distanced away from each other along the sheet ejection direction with the sheet receiving tray 3 interposed therebetween. The light emitter 9*a* emits light toward the light receiver 9*b*. The light emitter 9*a* and the light receiver 9*b* are arranged so that a light axis A on a light emitted by the light emitter 9*a* is made coincident with the reference position. The light emitter 9*a* and the light receiver 9*b* are also arranged within a lateral range of the center stem 27 along the left-to-right direction, i.e. arranged so that the emitted light passes through a center of the sheet stack plane.

The operation panel 10 receives a user's input operation(s), and displays various information and so on. The operation panel 10 is used communally for the sheet ejection device 1 and the printer 100. The operation panel 10 includes an input unit 37, and a display unit 38. The input unit 37 receives a user's input operation(s) and then output a signal(s) based on the user's input operation(s) to the controller 11. The input unit 37 has a keypad, a touchscreen and so on. The display unit 38 displays various information and so on. The display unit 38 has an LCD and so on.

The controller 11 controls overall operations of the sheet ejection device 1. In addition, the controller 11 communicates signals with the printer 100. The controller 11 is configured of a CPU, a RAM, a ROM, a HDD and so on. The controller 11 executes an elevation control of the sheet receiving tray 3 during a sheet ejection operation. Specifically, after a start of the sheet ejection operation, the controller 11 moves the sheet receiving tray 3 downward by a preset height H every ejection of the preset number N of sheets P until the sheet detection sensor 9 detects the sheets P (i.e. the emitted light is blocked by the stacked sheets P: this is denoted as "ON" hereinafter). After the sheet detection sensor 9 turns to "ON", the controller 11 newly starts to move the sheet receiving tray 3 downward by the preset height H every ejection of the preset number of sheets P. Note that the sheet detection sensor 9 is "OFF" while it doesn't detect the sheets P (i.e. the emitted light is not blocked by the stacked sheets P and received by the light receiver 9*b*). The controller 11 judges "ON" and "OFF" of the sheet detection sensor 9 based on a light amount received by the light receiver 9*b*.

Next, operations of the sheet ejection device 1 will be explained.

The sheet ejection device 1 executes a sheet ejection operation in response to a print operation of the printer 100. Before a start of the sheet ejection operation, the controller 11 executes a calibration of an upper plane. Specifically, the controller 11 starts to move the sheet receiving tray 3 upward by driving the elevation motor 32 in a normal rotational direction. Then, the controller 11 stops the elevation motor 32 at a time when the sheet detection sensor 9 turns to "ON". Subsequently, the controller 11 starts to move the sheet receiving tray 3 downward by driving the elevation motor 32 in a reverse rotational direction. Then, the controller 11 stops the elevation motor 32 at a time when the sheet detection sensor 9 turns to "OFF". In this manner, the calibration is finished. According to the calibration, the upper plane (an upper surface of the center stem 27 when no sheets P are stacked on the sheet receiving tray 3, or an upper surface of an uppermost sheet P of sheets P stacked on the sheet receiving tray 3) is made coincided with the reference position.

In addition, the controller 11 controls the side fence drive unit 6 and the end fence drive unit 8 to adjust positions of the side fences 5A and 5B and the end fence 7 according to a size of sheets P to be ejected. After the calibration and the adjustment are finished, the controller 11 starts the sheet ejection operation to eject sheets P sequentially fed from the printer 100 onto the sheet receiving tray 3 by using the sheet ejection unit 2.

Figure 4:
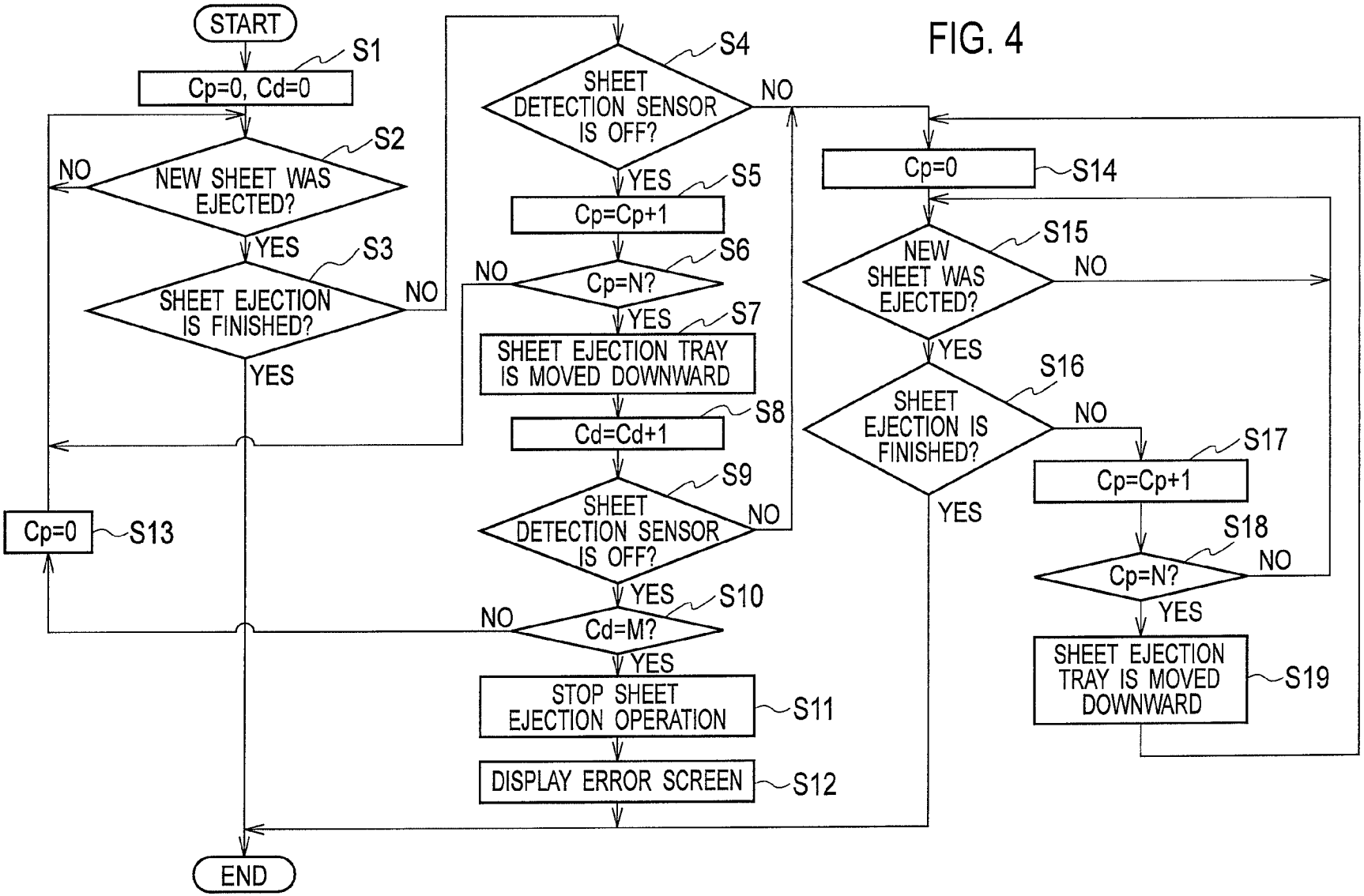
FIG. 4 is a flowchart of an elevation control of a sheet receiving tray of the sheet ejection device.

During the sheet ejection operation, the controller 11 executes the elevation operation to move the sheet receiving tray 3 downward. Hereinafter, the elevation operation will be explained with reference to a flowchart shown in FIG. 4.

When the sheet ejection operation is started, the controller 11 resets counters Cp and Cd to "0" (step S1). The counter Cp is a counter for counting the number of ejected sheets P. The counter Cd is a counter for counting the number of executions of downward movements of the sheet receiving tray 3. Note that the counter Cd is also reset when the sheet detection sensor 9 becomes "ON".

Then, it is judged whether or not a new sheet P was ejected (step S2). Here, the controller 11 judges, based on detection results by the sheet ejection sensor 23, whether or not a new sheet P was ejected. When the controller 11 judges that a new sheet P is not yet ejected (NO in step S2), the controller 11 repeats step S2 until step S2 is affirmed. On the other hand, when the controller 11 judges that a new sheet P was ejected (YES in step S2), the controller 11 judges whether or not sheet ejections of all printed sheets P are finished (step S3).

When the controller 11 judges that the sheet ejections of all printed sheets P are finished (YES in step S3), the controller 11 terminates the sheet ejection operation. On the other hand, when the controller 11 judges that the sheet ejections of all printed sheets P are not yet finished (NO in step S3), the controller 11 judges whether or not the sheet detection sensor 9 is OFF (step S4).

When the controller 11 judges that the sheet detection sensor 9 is ON (NO in step S4), the process flow proceeds to after-explained step S14. On the other hand, when the controller 11 judges that the sheet detection sensor 9 is OFF (YES in step S4), the controller 11 increments the counter Cp, i.e. adds "1" to the counter Cp (step S5).

After step S5, the controller 11 judges whether or not the counter Cp reaches the preset number N of sheets P (step S6). When the controller 11 judges that the counter Cp doesn't yet reach the preset number N of sheets P (NO in step S6), the process flow is returned to step S2. On the other hand, when the controller 11 judges that the counter Cp reaches the preset number N of sheets P (YES in step S6), the controller 11 drives the elevation motor 32 in a reverse rotational direction to move the sheet receiving tray 3 downward by the preset height level H (step S7).

After step S7, the controller 11 increments the counter Cd, i.e. adds "1" to the counter Cd (step S8). Subsequently, the controller 11 judges whether or not the sheet detection sensor 9 is OFF (step S9). When the controller 11 judges that the sheet detection sensor 9 is ON (NO in step S9), the process flow proceeds to after-explained step S14. On the other hand, when the controller 11 judges that the sheet detection sensor 9 is OFF (YES in step S9), the controller 11 judges whether or not the counter Cd reaches the preset number M of executions (step S10).

When the controller 11 judges that the counter Cd doesn't yet reaches the preset number M of executions (NO in step S10), the controller 11 resets the counter Cp to "0" (step S13) and then the process flow is returned to step S2. On the other hand, when the controller 11 judges that the counter Cd reaches the preset number M of executions (YES in step S10), the controller 11 stops the sheet ejection operation (step S11).

When the counter Cd reaches the preset number M of executions, in other words, when the downward movements of the sheet receiving tray 3 were executed M times but the sheet detection sensor 9 never detects stacked sheets P (YES in step S10), the sheet receiving tray 3 may be moved to an excessive lower level. If the sheet receiving tray 3 is located at an excessive lower level, an ejected sheet P may slip thorough lower ends of the side fences 5A and 5B and the end fence 7 and thereby stacked sheets P may be misaligned. Note that some of already-stacked sheets P may also slip thorough the lower ends of the side fences 5A and 5B and the end fence 7 together with the ejected sheet P. Also in this case, the stacked sheets P may be misaligned. Therefore, further misalignment of the stacked sheets P is restricted by stopping the sheet ejection operation (step S11).

Figure 5:
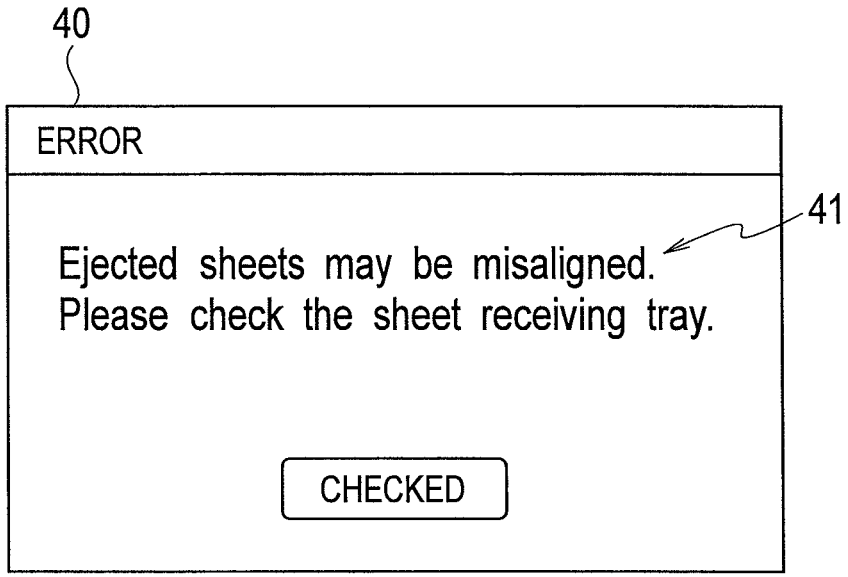
FIG. 5 shows an error screen to be displayed by the sheet ejection device.

After step S11, the controller 11 displays an error screen 40 shown in FIG. 5 on the display unit 38 (step S12), and then terminates the sheet ejection operation. By the error screen 40, a message 41 for warning probability of sheet misalignment is shown to a user.

When the controller 11 judges that the sheet detection sensor 9 is ON in step S4 or S9 (NO in step S4 or S9), the controller 11 resets the counter Cp to "0" (step S14). Subsequently, the controller 11 judges whether or not a new sheet P was ejected (step S15). When the controller 11 judges that a new sheet P is not yet ejected (NO in step S15), the controller 11 repeats step S15 until step S15 is affirmed. On the other hand, when the controller 11 judges that a new sheet P was ejected (YES in step S15), the controller 11 judges whether or not sheet ejections of all printed sheets P are finished (step S16). When the controller 11 judges that the sheet ejections of all printed sheets P are finished (YES in step S16), the controller 11 terminates the sheet ejection operation.

On the other hand, when the controller 11 judges that the sheet ejections of all printed sheets P aren't yet finished (NO in step S16), the controller 11 increments the counter Cp, i.e. adds "1" to the counter Cp (step S17). Subsequently, the controller 11 judges whether or not the counter Cp reaches the preset number N of sheets P (step S18). When the controller 11 judges that the counter Cp doesn't yet reach the preset number N of sheets P (NO in step S18), the process flow is returned to step S15. On the other hand, when the controller 11 judges that the counter Cp reaches the preset number N of sheets P (YES in step S18), the controller 11 drives the elevation motor 32 in a reverse rotational direction to move the sheet receiving tray 3 downward by the preset height level H (step S19) and then the process flow is returned to step S14.

As explained above, after the sheet ejection is started, the controller 11 moves the sheet receiving tray 3 downward (step S7) by the preset height level H every ejection of the preset number N of sheets P until the sheet detection sensor 9 turns to "ON". After the sheet detection sensor 9 turns to "ON" (YES in step S4 or S9), the controller 11 newly starts to move the sheet receiving tray 3 downward (step S7) by the preset height level H every ejection of the preset number N of sheets P (step S19).

Figure 6:
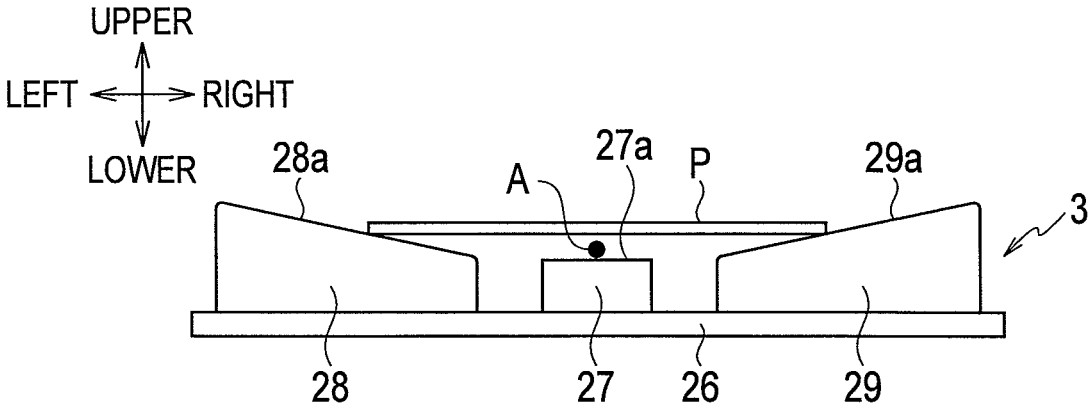
FIG. 6 is a front view showing a state where a gap is formed between stacked sheet and the sheet receiving tray.

If ejected sheets P are relatively small-sized and thick and thereby the ejected sheets P don't follow the sheet stack plane, a gap may be formed between the sheets P and the sheet stack plane as explained above. In such a case, the light axis A of the sheet detection sensor 9 passes through the gap as shown in FIG. 6, so that the stacked sheets P can't be detected even while sheets P are sequentially ejected onto the sheet receiving tray 3.

Figure 7:
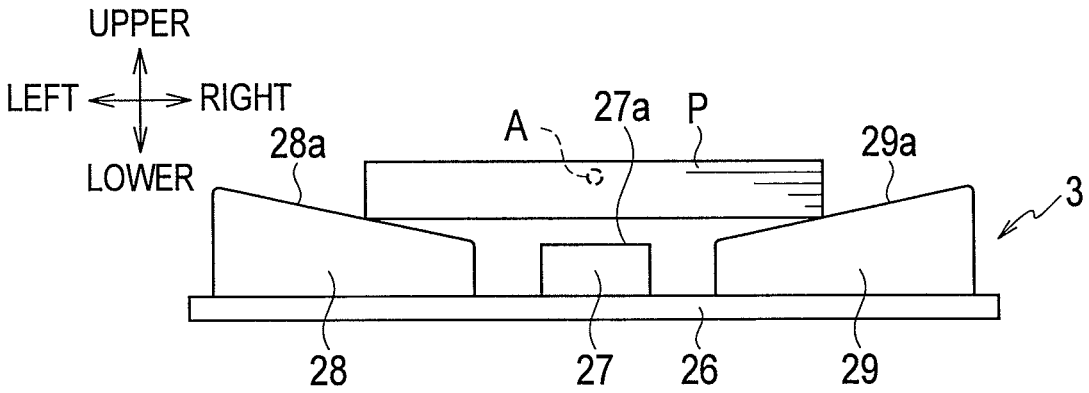
FIG. 7 is a front view showing an example where a sheet detection sensor detects stacked sheets that don't follow a shape of a sheet stack plane of the sheet receiving tray.

According to the present embodiment, even in the above-explained case (detection of the stacked sheets P is failed due to the gap), the sheet receiving tray 3 is moved downward by the preset height level H every ejection of the preset number N of sheets P from the sheet ejection operation is started until the sheet detection sensor 9 turns to "ON". Therefore, the sheet detection sensor 9 can be turned to "ON" eventually as shown in FIG. 7 (the sheet receiving tray 3 shown in FIG. 7 is moved downward from a state shown in FIG. 6). After (From a time when) the sheet detection sensor 9 turns to "ON", it is newly started that the sheet receiving tray 3 is moved downward by the preset height level H every ejection of the preset number N of sheets P.

According to the above-explained sheet ejection operation under an irregular condition, the sheet ejection operation can be prevented from being continued in a situation where the sheet detection sensor 9 never detects sheets P at the reference position, i.e. a situation where no downward movement of the sheet receiving tray 3 is made because of the gap formed between the sheet stack plane and the stacked sheets P. Therefore, erroneous stacking of sheets P can be restricted. Specifically, prevented can be paper jams caused by excessive stacking of sheets P up to the height level of the sheet ejection rollers 21.

Figure 8:
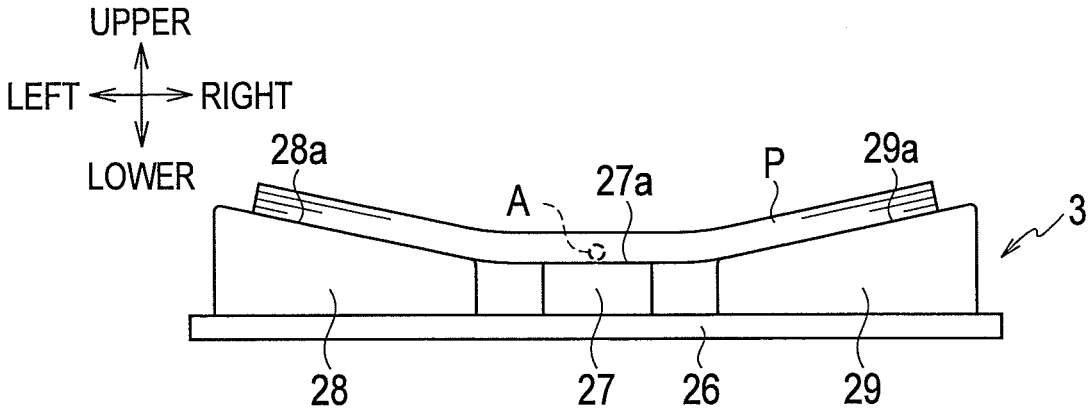
FIG. 8 is a front view showing an example where stacked sheets follows the shape of the sheet stack plane of the sheet receiving tray.

In a case where stacked sheets P follow a shape of the sheet stack plane of the sheet receiving tray 3, the sheet detection sensor 9 turns to "ON" as shown in FIG. 8 before the number of ejected sheets P from the start of the sheet ejection operation reaches the preset number N of sheets P. After (From a time when) the sheet detection sensor 9 turns to "ON", the sheet receiving tray 3 is moved downward by the preset height level H every ejection of the preset number N of sheets P. According to this sheet ejection operation under a normal condition, the sheet receiving tray 3 can be moved downward along with increase of stacked sheets P.

In addition, the sheet ejection operation is stopped when the counter Cd reaches the preset number M of executions in the above sheet ejection device 1, so that further misalignment (erroneous stacking) of ejected sheets P can be prevented. Note that the preset numbers N of sheets P may be determined according to types of sheets P to be ejected. The preset numbers M of executions may be also determined according to types of sheets P to be ejected.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C. §119 to Japanese Patent Application No. 2012-284852, filed on Dec. 27, 2012, the entire content of which is incorporated herein by reference.

What is claimed is:

1. A sheet ejection device comprising:

a vertically movable sheet receiving tray that is provided with a sheet stack plane, both side ends of the sheet stack plane being made higher than a center of the sheet stack plane when viewed along a sheet ejection direction;

a sheet ejection unit that sequentially ejects sheets onto the sheet receiving tray;

a detector that detects sheets ejected by the sheet ejection unit at a reference position, the reference position being a position that functions as a reference for a height level of a center of an uppermost surface of stacked sheets on the sheet stack plane; and a controller, during a sheet ejection operation, moves the sheet receiving tray downward by a preset height level each time a preset number of sheets are ejected until the detector detects sheets at the reference position, and after the detector detects sheets at the reference position, the controller restarts the moving of the sheet receiving tray downward by the preset height level each time the preset number of sheets are ejected.

2. The sheet ejection device according to claim 1, wherein, when the controller moves the sheet receiving tray downward a preset number of times before the detector firstly detects sheets at the reference position, the controller stops the sheet ejection operation.

* * * * *